US009245480B2

(12) United States Patent
Kim et al.

(10) Patent No.: US 9,245,480 B2
(45) Date of Patent: Jan. 26, 2016

(54) ORGANIC LIGHT EMITTING DIODE DISPLAY WITH VERTICAL COMPENSATION CONTROL LINE FORMED IN PARALLEL WITH THE DATA LINE

(71) Applicant: Samsung Display Co., Ltd., Yongin, Gyeonggi-Do (KR)

(72) Inventors: Yong-Jae Kim, Yongin (KR); Hae-Yeon Lee, Yongin (KR); Keum-Nam Kim, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 164 days.

(21) Appl. No.: 13/965,895

(22) Filed: Aug. 13, 2013

(65) Prior Publication Data

US 2014/0049455 A1 Feb. 20, 2014

(30) Foreign Application Priority Data

Aug. 14, 2012 (KR) ..... 10-2012-0089114

(51) Int. Cl.
*G09G 3/32* (2006.01)

(52) U.S. Cl.
CPC ..... *G09G 3/3258* (2013.01); *G09G 3/3233* (2013.01); *G09G 2300/0426* (2013.01); *G09G 2300/0814* (2013.01); *G09G 2300/0819* (2013.01); *G09G 2300/0852* (2013.01); *G09G 2320/0223* (2013.01); *G09G 2320/043* (2013.01)

(58) Field of Classification Search
None
See application file for complete search history.

(56) References Cited

U.S. PATENT DOCUMENTS

| | | | | |
|---|---|---|---|---|
| 2004/0201555 | A1* | 10/2004 | Ozawa | 345/76 |
| 2010/0201673 | A1 | 8/2010 | Kim et al. | |
| 2012/0026147 | A1 | 2/2012 | Komiya | |
| 2012/0146999 | A1 | 6/2012 | Hwang et al. | |
| 2012/0327058 | A1* | 12/2012 | Minami et al. | 345/211 |

FOREIGN PATENT DOCUMENTS

| | | | |
|---|---|---|---|
| EP | 2642476 | A1 | 9/2013 |
| KR | 10-0642491 | B | 10/2006 |
| KR | 10-2010-0049385 | A | 5/2010 |
| KR | 10-2012-0062499 | A | 6/2012 |

OTHER PUBLICATIONS

The extended European Search Report issued on Oct. 17, 2014 by EPO in connection with European Patent Application No. 13180243.1 which also claims Korean Patent Application No. 10-2012-0089114 as its priority document.

* cited by examiner

*Primary Examiner* — David D Davis
(74) *Attorney, Agent, or Firm* — Robert E. Bushnell, Esq.

(57) ABSTRACT

An organic light emitting diode display including a substrate, a scan line transferring a scan signal, a compensation control line transferring a compensation control signal, an operation control line applying an operation control signal, a data line and a driving voltage line transferring a data signal and a driving voltage, respectively, a switching thin film transistor (TFT) connected to the scan line and the data line, a compensation TFT and an initialization TFT connected to the compensation control line, an operation control TFT connected to the operation control line and the switching TFT, a driving TFT connected to the driving voltage line, an organic light emitting diode connected to a drain electrode of the driving TFT, and a hold capacitor connected between a source electrode of the operation control TFT and a gate electrode of the initialization TFT.

11 Claims, 5 Drawing Sheets

ORGANIC LIGHT EMITTING DIODE DISPLAY WITH VERTICAL COMPENSATION CONTROL LINE FORMED IN PARALLEL WITH THE DATA LINE

CLAIM OF PRIORITY

This application makes reference to, incorporates the same herein, and claims all benefits accruing under 35 U.S.C. §119 from an application earlier filed in the Korean Intellectual Property Office on the $14^{th}$ of Aug. 2012 and there duly assigned Serial No. 10-2012-0089114.

BACKGROUND OF THE INVENTION

1. Field of the Invention

The described technology relates generally to an organic light emitting diode display.

2. Description of the Related Art

An organic light emitting diode display includes two electrodes and an organic emission layer interposed therebetween, electrons injected from one electrode and holes injected from the other electrode are bonded to each other in the organic emission layer to form an exciton, and light is emitted while the exciton discharges energy.

The organic light emitting diode display includes a plurality of pixels, each including an organic light emitting diode that is a self-light emitting element, and a plurality of thin film transistors and capacitors for driving the organic light emitting diodes are formed in each pixel.

One frame of the organic light emitting diode display includes a scanning period for programming data, and a light emitting period during which light is emitted according to the programmed data. However, as the organic light emitting diode display is enlarged and resolution is increased, a signal delay phenomenon of the organic light emitting diode display is increased. Accordingly, the scanning period and the light emitting period are not sufficiently ensured, thus, it is difficult to drive the organic light emitting diode display.

The above information disclosed in this Background section is only for enhancement of understanding of the background of the described technology and therefore it may contain information that does not form the prior art that is already known in this country to a person of ordinary skill in the art.

SUMMARY OF THE INVENTION

The described technology has been made in an effort to provide an organic light emitting diode display that is suitable for enlargement and high resolution.

An exemplary embodiment provides an organic light emitting diode display including a substrate, a scan line formed on the substrate to transfer a scan signal, a compensation control line crossing the scan line to transfer a compensation control signal, an operational control line crossing the scan line and apply an operation control signal, and a data line and a driving voltage line crossing the scan line to transfer a data signal and a driving voltage, respectively. A switching thin film transistor is connected to the scan line and the data line, a compensation thin film transistor and an initialization thin film transistor is connected to the compensation control line, an operation control thin film transistor is connected to the operation control line and the switching thin film transistor, a driving thin film transistor is connected to the driving voltage line, an organic light emitting diode is connected to a driving drain electrode of the driving thin film transistor, and a hold capacitor is connected between an operation control source electrode of the operation control thin film transistor and an initialization gate electrode of the initialization thin film transistor The compensation control line includes a vertical compensation control line formed in parallel to the data line and a horizontal compensation control line connected to the vertical compensation control line to cross the vertical compensation control line.

The organic light emitting diode display may further include a storage capacitor connected between the driving voltage line and the operation control thin film transistor, and a compensation capacitor connected between the operation control thin film transistor and the driving gate electrode of the driving thin film transistor.

The hold capacitor may include a first hold condenser plate connected to a drain electrode of the switching thin film transistor, and a second hold condenser plate overlapping the first hold condenser plate and connected to the horizontal compensation control line.

The first hold condenser plate may be formed on the same layer as a switching semiconductor layer of the switching thin film transistor, and the second hold condenser plate may be formed on the same layer as the scan line.

The second hold condenser plate may protrude upward and downward from the horizontal compensation control line.

The horizontal compensation control line may include a gate metal layer and a transparent electrode layer sequentially laminated, and the second hold condenser plate may be formed of only a transparent electrode layer.

The vertical compensation control line may be formed on the same layer as the data line.

The organic light emitting diode display may further include a gate insulating layer formed on the first hold condenser plate, and an interlayer insulating layer covering the second hold condenser plate formed on the gate insulating layer, wherein the horizontal compensation control line is connected through a contact hole formed in the interlayer insulating layer to the vertical compensation control line.

The driving voltage line may include a vertical driving voltage line formed in parallel to the data line and a horizontal driving voltage line connected to the vertical driving voltage line to cross the vertical driving voltage line.

The operation control line may include a vertical operation control line formed in parallel to the data line and a horizontal operation control line connected to the vertical operation control line to cross the vertical operation control line.

The vertical operation control line may be formed on the same layer as the data line, and the horizontal operation control line may be formed on the same layer as the scan line.

According to an exemplary embodiment, in a simultaneous emission with active voltage (SEAV) type organic light emitting diode display that is suitable for high resolution and enlargement, a second hold condenser plate of a hold capacitor holding a data signal while an organic light emitting diode emits light can be connected to a vertical compensation control line to be used as a horizontal compensation control line, such that both the vertical compensation control line and the horizontal compensation control line can be formed to prevent occurrence of mura due to a signal delay.

Further, since the second hold condenser plate of the hold capacitor is used as the horizontal compensation control line, a separate horizontal compensation control line may not need to be formed, thus preventing deterioration of an opening ratio generated in the case where the separate horizontal compensation control line is formed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
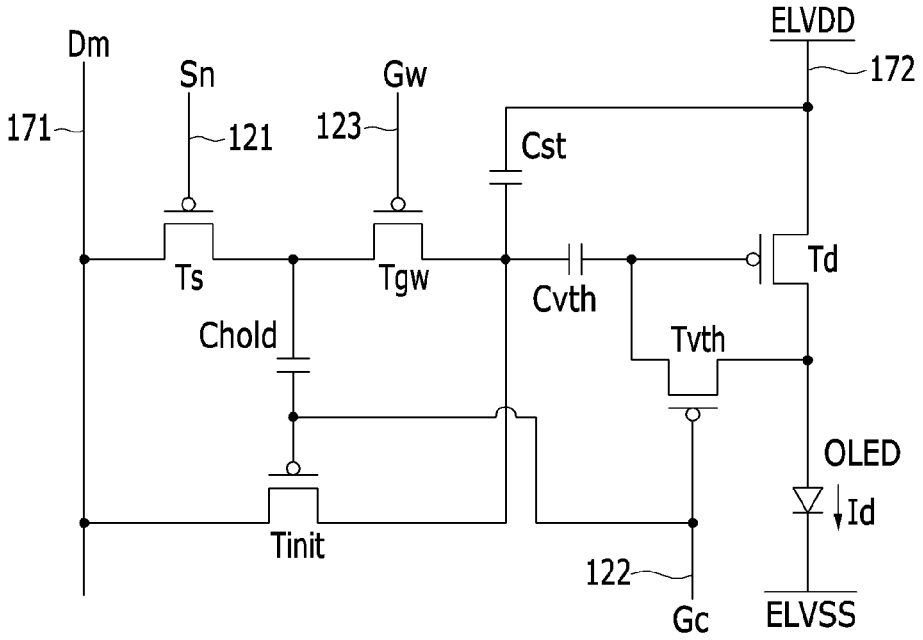
FIG. 1 is an equivalent circuit of one pixel of an organic light emitting diode display according to an exemplary embodiment.

Hereinafter, the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

Further, the size and thickness of each component shown in the drawings are arbitrarily shown for understanding and ease of description, but the present invention is not limited thereto.

In the drawings, the thickness of layers, films, panels, regions, etc., are exaggerated for clarity. In the drawings, for understanding and ease of description, the thickness of some layers and areas is exaggerated. It will be understood that when an element such as a layer, film, region, or substrate is referred to as being "on" another element, it can be directly on the other element or intervening elements may also be present.

Then, an organic light emitting diode display according to an exemplary embodiment will be described in detail with reference to FIGS. 1 to 5.

FIG. 1 is an equivalent circuit of one pixel of an organic light emitting diode display according to an exemplary embodiment.

As shown in FIG. 1, one pixel of the organic light emitting diode display includes a plurality of signal lines 121, 122, 123, 171, and 172, and a plurality of thin film transistors Td, Ts, Tvth, Tinit, and Tgw, a plurality of capacitors Cst, Chold, and Cvth, and an organic light emitting diode OLED connected to a plurality of signal lines.

The plurality of thin film transistors includes a driving thin film transistor Td, a switching thin film transistor Ts, a compensation thin film transistor Tvth, an initialization thin film transistor Tinit, and an operation control thin film transistor Tgw. The plurality of capacitors includes a storage capacitor Cst, a hold capacitor Chold, and a compensation capacitor Cvth.

The signal lines include a scan line 121 transferring a scan signal Sn, a compensation control line 122 transferring a compensation control signal Gc to the compensation thin film transistor Tvth and the initialization thin film transistor Tinit, an operation control line 123 transferring an operation control signal Gw to the operation control thin film transistor Tgw, a data line 171 transferring a data signal Dm, and a driving voltage line 172 transferring a driving voltage ELVDD to the driving thin film transistor Td.

The gate electrode of the driving thin film transistor Td is connected to one end of the compensation capacitor Cvth, the source electrode of the driving thin film transistor Td is connected to the driving voltage line 172 and to one end of storage capacitor Cst, and the drain electrode of the driving thin film transistor Td is electrically connected to an anode of the organic light emitting diode OLED.

The gate electrode of the initialization thin film transistor Tinit is connected to the compensation control line 122 and to the hold capacitor Chold, the source electrode of the initialization thin film transistor Tinit is connected to the data line 171, and the drain electrode of the initialization thin film transistor Tinit is connected to another end of the compensation capacitor Cvth and to the drain electrode of the operation control thin film transistor Tgw. The initialization thin film transistor Tinit is turned on according to compensation control signal Gc transferred through the compensation control line 122. Then, the voltage of the gate electrode of the driving thin film transistor Td is initialized through the data line 171.

The gate electrode of the compensation thin film transistor Tvth is connected to the compensation control line 122, the source electrode of the compensation thin film transistor Tvth is connected to the drain electrode of the driving thin film transistor Td and to the anode of the organic light emitting diode OLED. The drain electrode of the compensation thin film transistor Tvth is connected to the one end of the compensation capacitor Cvth and to the gate electrode of the driving thin film transistor Td. The compensation thin film transistor Tvth is turned-on according to the compensation control signal Gc to connect the gate electrode and the drain electrode of the driving thin film transistor Td to each other, thus performing diode-connection of the driving thin film transistor Td.

A voltage corresponding to a threshold voltage of the driving thin film transistor Td is programmed in the compensation capacitor Cvth during a diode-connection period of the driving thin film transistor Td.

The gate electrode of the switching thin film transistor Ts is connected to the scan line 121, the source electrode of the switching thin film transistor Ts is connected to the data line 171, the drain electrode of the switching thin film transistor Ts is connected to another end of the holding capacitor Chold and to the source electrode of the operation control thin film transistor Tgw. The switching thin film transistor Ts is turned on according to the scan signal Sn and a scanning operation where the data signal Dm transferred from the data line 171 is programmed in the holding capacitor Chold is performed.

The gate electrode of the operation control thin film transistor Tgw is connected to the operation control line 123, the source electrode of the operation control thin film transistor Tgw is connected in common to the another end of the hold capacitor Chold and to the drain electrode of the switching thin film transistor Ts, and the drain electrode of the operation control thin film transistor Tgw is connected in common to the drain electrode of the initialization thin film transistor, to the another end of the compensation capacitor Cvth and to another end of the storage capacitor Cst.

The operation control thin film transistor Tgw is turned off while the organic light emitting diode OLED emits light. A data signal is programmed in the hold capacitor Chold during this period. That is, the operation control thin film transistor Tgw electrically blocks the hold capacitor Chold and the storage capacitor Cst from each other so that the light emission and data programming operations are simultaneously performed.

The data voltage transferred through the switching thin film transistor Ts turned on during a scanning period of an i-th frame is programmed in the hold capacitor Chold. The operation control thin film transistor Tgw is turned on during a period from at a time at which the light emitting period of the i-th frame is finished to a time at which the i+1-th light emitting period starts, and the data signal stored in the hold capacitor Chold is transferred to the storage capacitor Cst during a turn-on period.

One end of the storage capacitor Cst is connected in common to the driving voltage line 172 and to the source electrode of driving transistor Td, and a gate-source voltage of the driving transistor Td is determined according to a voltage programmed in the compensation capacitor Cvth and the storage capacitor Cst. The cathode of the organic light emitting diode OLED is connected to a common voltage ELVSS.

The organic light emitting diode OLED emits light according to a driving current Id transferred from the driving voltage ELVDD through the driving thin film transistor Td, and the driving current Id flows as a common voltage ELVSS.

As described above, the organic light emitting diode display according to the exemplary embodiment is operated according to a driving method where a plurality of pixels simultaneously emits light during a present frame period according to the data voltage programmed in a prior frame and present frame data are simultaneously programmed in a plurality of pixels.

Then, a detailed structure of the pixel of the organic light emitting diode display shown in FIG. 1 will be described in detail with reference to FIGS. 2 to 5 together with FIG. 1.

Figure 2:
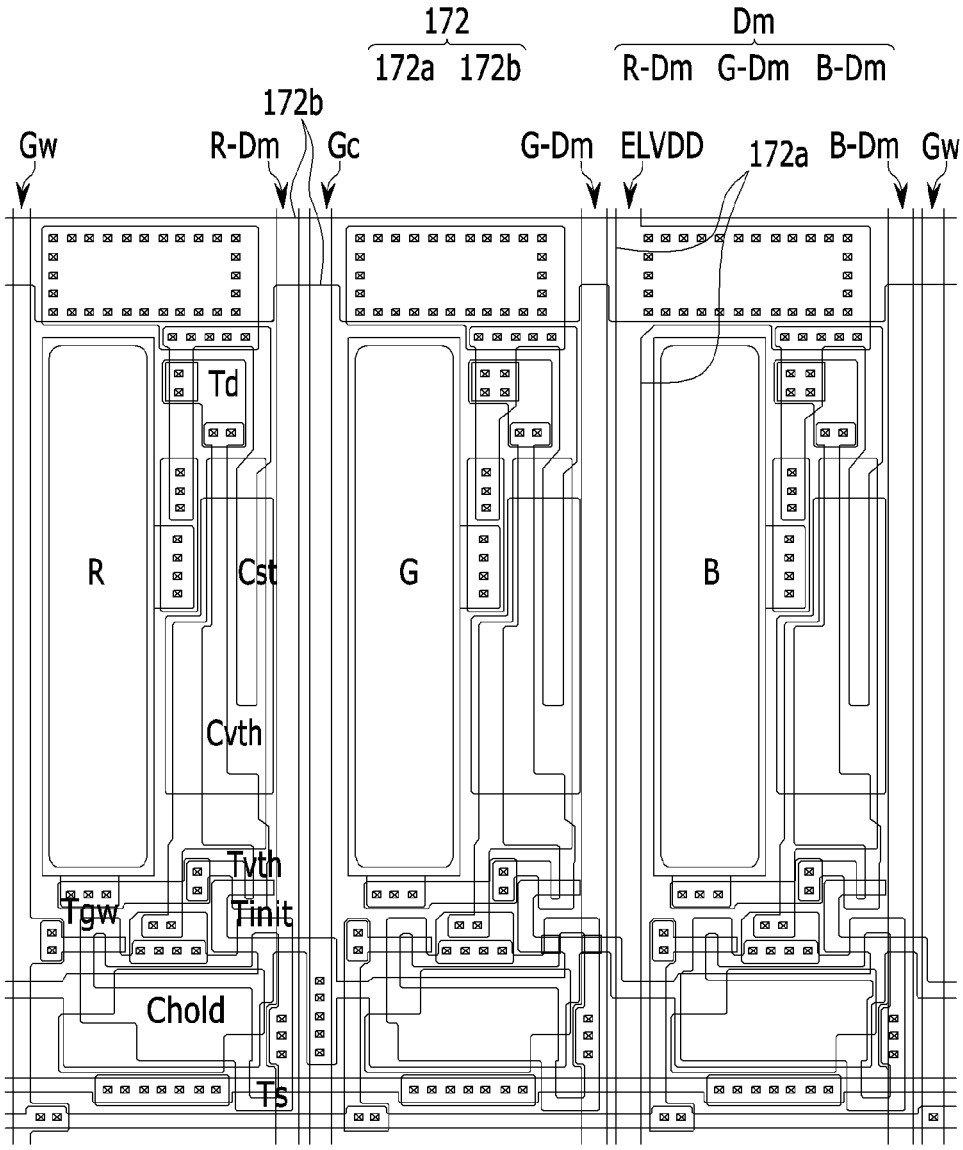
FIG. 2 is a view schematically showing positions of a plurality of thin film transistors and capacitors in three pixels of the organic light emitting diode display according to the exemplary embodiment.

FIG. 2 is a view schematically showing positions of a plurality of thin film transistors and capacitors in three pixels of the organic light emitting diode display according to the exemplary embodiment.

FIG. 2 is a view schematically showing positions three pixels, R (red) G (green) and B (blue) having, in particular, the plurality of thin film transistors and capacitors with respect to the R pixel, noting that the arrangement is similar with respect to the G and B pixels. Also shown are corresponding red, green and blue data signals R-Dm, G-Dm and B-Dm, respectively, as well as driving voltage lines 172*a* and 172*b* for applying the driving voltage ELVDD to the R, G and B pixels.

Figure 3:
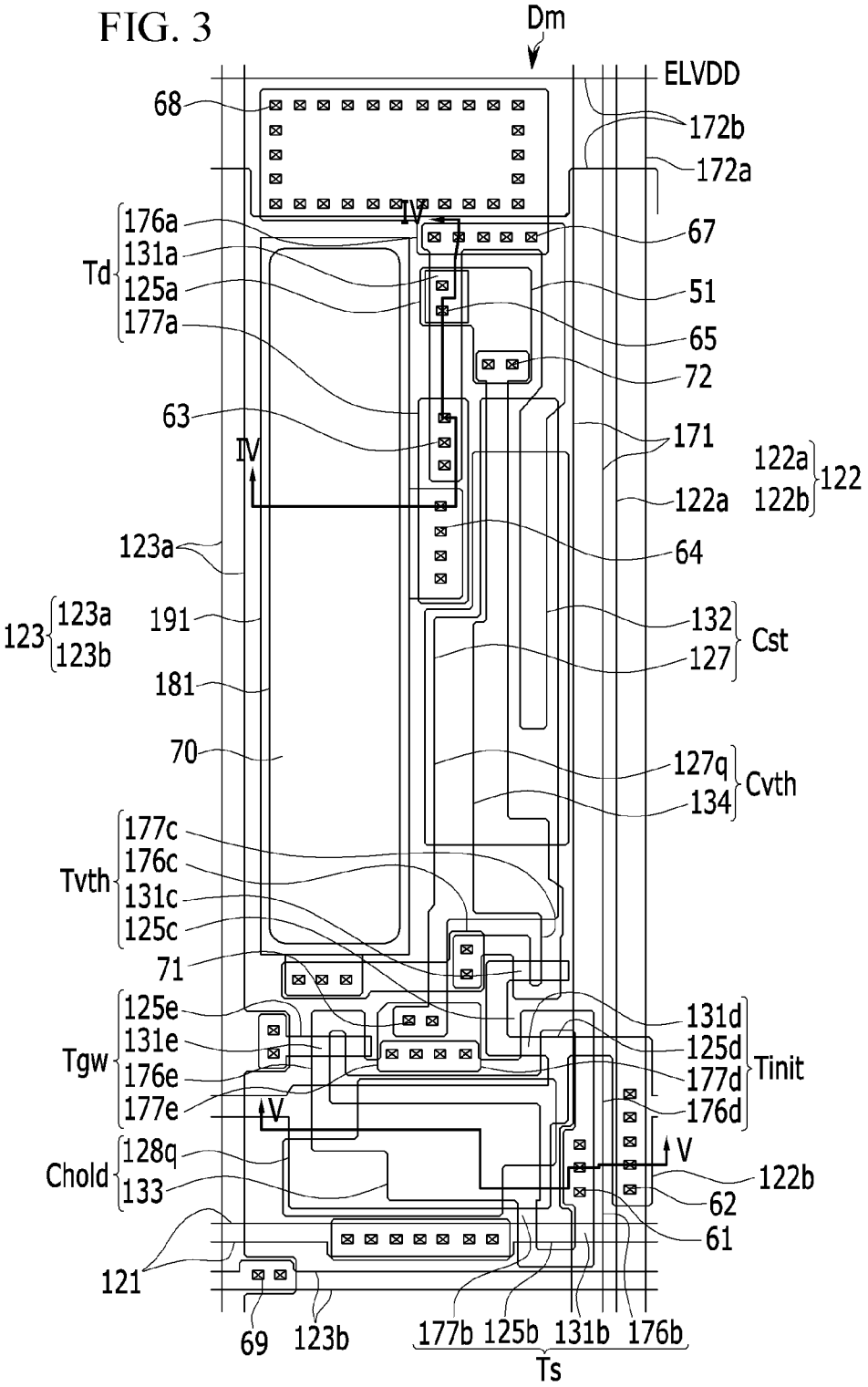
FIG. 3 is a specific layout view of one pixel of the organic light emitting diode display according to the exemplary embodiment.
Figure 4:
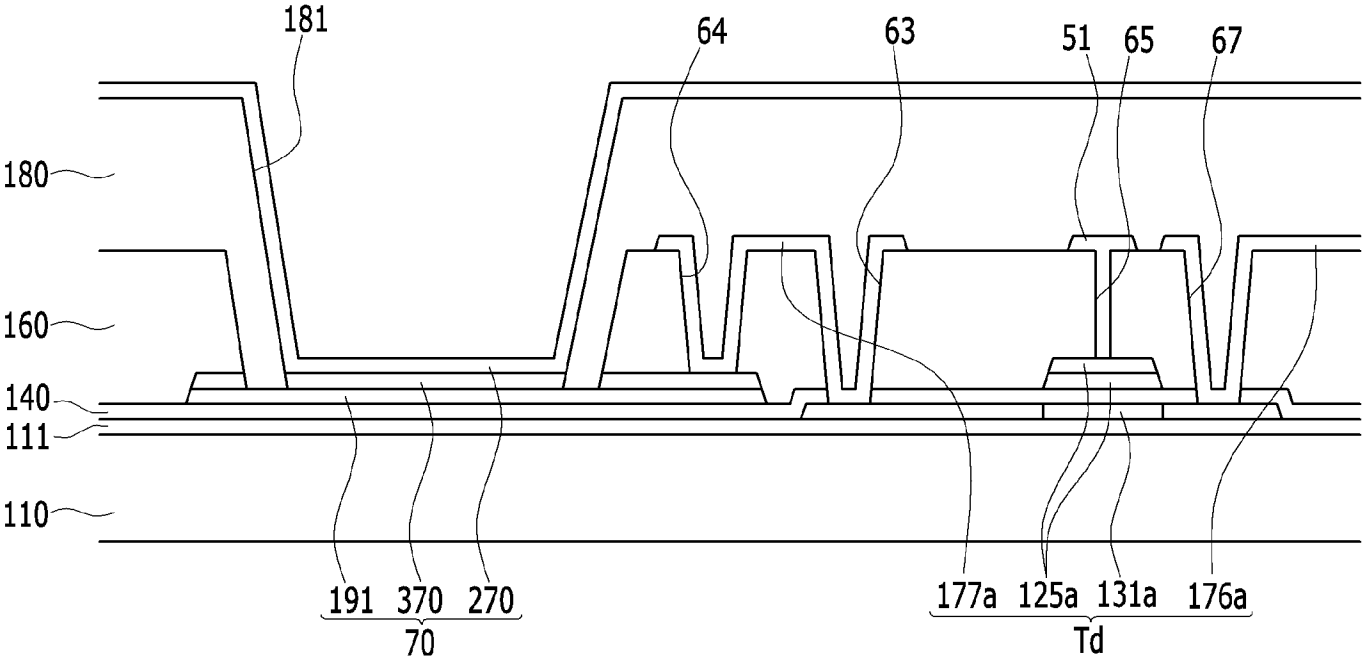
FIG. 4 is a cross-sectional view of the organic light emitting diode display of FIG. 3, which is taken along line IV-IV.
Figure 5:
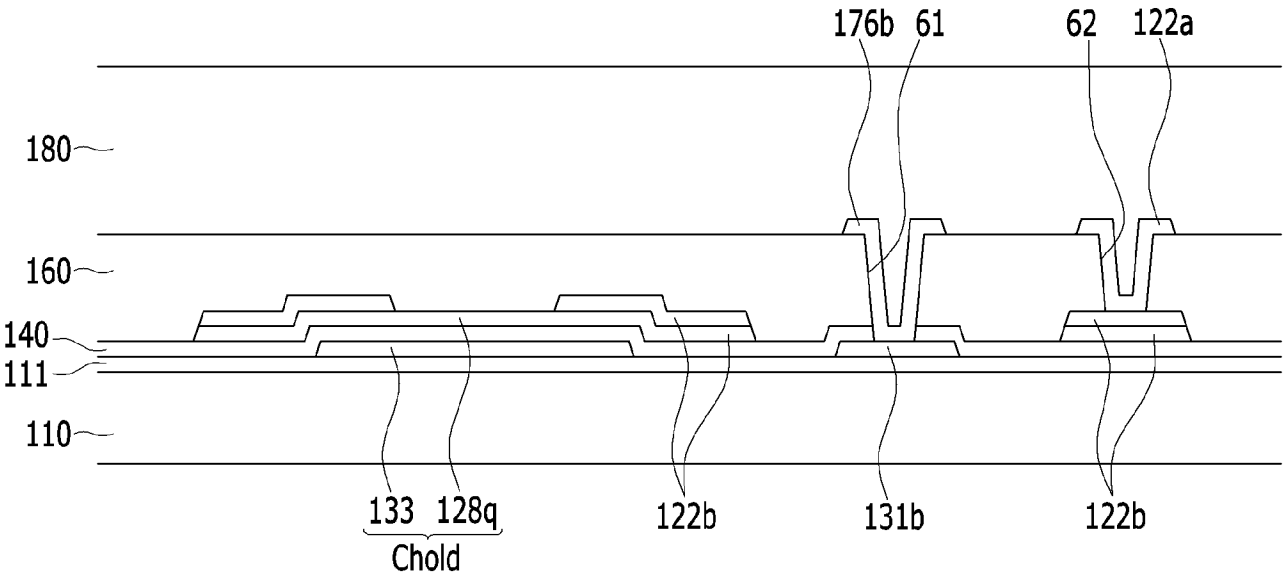
FIG. 5 is a cross-sectional view of the organic light emitting diode display of FIG. 3, which is taken along line V-V.

FIG. 3 is a specific layout view of one pixel of the organic light emitting diode display according to the exemplary embodiment, FIG. 4 is a cross-sectional view of the organic light emitting diode display of FIG. 3, which is taken along line IV-IV, and FIG. 5 is a cross-sectional view of the organic light emitting diode display of FIG. 3, which is taken along line V-V.

As shown in FIGS. 3 to 5, the pixel of the organic light emitting diode display according to the exemplary embodiment includes the scan line 121 transferring the scan signal Sn and formed in a row direction, the compensation control line 122 (122*a*, 122*b*) transferring the compensation control signal Gc and formed in a row direction and a column direction, the operation control line 123 (123*a*, 123*b*) transferring the operation control signal Gw and formed in a row direction and a column direction, and the data line 171 and the driving voltage line 172 (172*a*, 172*b*), crossing the scan line 121, the compensation control line 122, and the operation control line 123, and transferring the data signal Dm and the driving voltage ELVDD to the pixel, respectively.

The compensation control line 122 includes a vertical compensation control line 122*a* formed in parallel to the data line 171 and a horizontal compensation control line 122*b* connected to the vertical compensation control line 122*a* to cross the vertical compensation control line 122*a*, the operation control line 123 includes a vertical operation control line 123*a* formed in parallel to the data line 171 and a horizontal operation control line 123*b* connected to the vertical operation control line 123*a* to cross the vertical operation control line 123*a*, and the driving voltage line 172 includes a vertical driving voltage line 172*a* formed in parallel to the data line 171 and a horizontal driving voltage line 172*b* connected to the vertical driving voltage line 172*a* to cross the vertical driving voltage line 172*a*.

The data lines 171 transfer data signals Dm (R-Dm, G-Dm, and B- to three pixels, that is, a red pixel R, a green pixel G, and a red pixel B, respectively, as shown in FIG. 2), the driving voltage line 172 transfers the driving voltage ELVDD transferred through the vertical driving voltage line 172*a* to all the three pixels by using the horizontal driving voltage line 172*b*, the compensation control line 122 transfers the compensation control signal Gc transferred through the vertical compensation control line 122*a* to all the three pixels by using the horizontal compensation control line 122*b*, and the operation control line 123 transfers the operation control signal Gw transferred through the vertical operation control line 123*a* to all the three pixels by using the horizontal operation control line 123*b*.

Further, in the pixel, the driving thin film transistor Td, the switching thin film transistor Ts, the compensation thin film transistor Tvth, the initialization thin film transistor Tinit, the operation control thin film transistor Tgw, the storage capacitor Cst, the hold capacitor Chold, the compensation capacitor Cvth, and the organic light emitting diode 70 are formed.

The driving thin film transistor Td, the switching thin film transistor Ts, the compensation thin film transistor Tvth, the initialization thin film transistor Tinit, and the operation control thin film transistor Tgw are formed along the semiconductor layer 131, and the semiconductor layer 131 is bent to have various shapes. The semiconductor layer 131 is formed of polysilicon, and includes a channel region not doped with an impurity and a source region and a drain region formed at both sides of the channel region to be doped with the impurity. Herein, the impurity is changed according to a kind of thin film transistor, and an N type impurity or a P type impurity is feasible. The semiconductor layer includes a driving semiconductor layer 131*a* formed on the driving thin film transistor Td, a switching semiconductor layer 131*b* formed on the switching thin film transistor Ts, a compensation semiconductor layer 131*c* formed on the compensation thin film transistor Tvth, an initialization semiconductor layer 131*d* formed on the initialization thin film transistor Tinit, and an operation control semiconductor layer 131*e* formed on the operation control thin film transistor Tgw.

The driving thin film transistor Td includes the driving semiconductor layer 131*a*, the driving gate electrode 125*a*, the driving source electrode 176*a*, and the driving drain electrode 177*a*.

The switching thin film transistor Ts includes the switching semiconductor layer 131*b*, the switching gate electrode 125*b*, the switching source electrode 176*b*, and the switching drain electrode 177*b*. The switching drain electrode 177*b* corresponds to the switching drain region doped with the impurity in the switching semiconductor layer 131*b*.

The compensation thin film transistor Tvth includes the compensation semiconductor layer 131*c*, the compensation gate electrode 125*c*, the compensation source electrode 176*c*, and the compensation drain electrode 177*c*, and the compensation drain electrode 177*c* corresponds to a compensation drain region doped with the impurity in the compensation semiconductor layer 131*c*. The initialization thin film transistor Tinit includes the initialization semiconductor layer 131*d*, the initialization gate electrode 125*d*, the initialization source electrode 176*d*, and the initialization drain electrode 176*e*.

The operation control thin film transistor Tgw includes the operation control semiconductor layer 131*e*, the operation control gate electrode 125*e*, the operation control source electrode 176*e*, and the operation control drain electrode 177*e*, and the operation control source electrode 176*e* corresponds to an operation control source region doped with the impurity in the operation control semiconductor layer 131*e*.

The storage capacitor Cst includes a first storage condenser plate 132 and a second storage condenser plate 127 with the gate insulating layer 140 interposed therebetween. Herein, the gate insulating layer 140 is a dielectric material, and a storage capacitance is determined by charges accumulated in the storage capacitor Cst and a voltage between both condenser plates 132 and 127.

The first storage condenser plate 132 is formed on the same layer as the driving semiconductor layer 131*a*, the switching semiconductor layer 131*b*, the compensation semiconductor layer 131*c*, the initialization semiconductor layer 131*d*, and the operation control semiconductor layer 131*e*, and the second storage condenser plate 127 is formed on the same layer as the scan line 121.

A second compensation condenser plate 127*q* is connected through a contact hole 71 formed in an interlayer insulating layer 160 and a gate insulating layer 140 to the initialization drain electrode 177*d* and the operation control drain electrode 177*e*.

The hold capacitor Chold includes a first hold condenser plate 133 and a second hold condenser plate 128*q* with the gate insulating layer 140 interposed therebetween. The first hold condenser plate 133 is formed on the same layer as the semiconductor layer 131, and the second hold condenser plate 128*q* is formed on the same layer as the scan line 121.

The first hold condenser plate 133 is connected to the operation control source electrode 176*e* and the switch drain electrode 177*b*.

Hereinafter, referring to FIGS. 4 and 5, as well as referring back to FIG. 3, a structure of the organic light emitting diode display according to the exemplary embodiment will be described in detail according to the lamination order.

In this case, a structure of the thin film transistor will be described with the driving thin film transistor Td as a main part. Further, the residual thin film transistors Ts, Tvth, Tinit, and Tgw are mostly the same as the lamination structure of the driving thin film transistor Td, and thus are not described in further detail.

A buffer layer 111 is formed on the substrate 110, and the driving semiconductor layer 131*a* and the first hold condenser plate 133 forming the hold capacitor Chold are formed on the buffer layer 111. The substrate 110 is formed of an insulating substrate made of glass, quartz, ceramics, plastics, and the like.

A gate insulating layer 140 formed of silicon nitride (SiNx) or silicon oxide ($SiO_2$) is formed on the driving semiconductor layer 131*a* and the first hold condenser plate 133.

The scan line 121 including the switching gate electrode 125*b*, the horizontal compensation control line 122*b* including the compensation gate electrode 125*c* and the initialization gate electrode 125*d*, and the gate wire including the driving gate electrode 125*a* and the operation control gate electrode 125*e* are formed on the gate insulating layer 140. The gate wire further includes the second compensation condenser plate 127*q* forming the storage capacitor Cst and the compensation capacitor Cvth, the second hold condenser plate 128*q* forming the hold capacitor Chold, and the horizontal driving voltage line 172*b*. The second hold condenser plate 128*q* protrudes upward and downward from a portion of the horizontal compensation control line 122*b*.

The gate wire includes a gate metal layer and a transparent electrode layer sequentially laminated, accordingly, the driving gate electrode 125*a* and the horizontal compensation control line 122*b* include the gate metal layer and the transparent electrode layer sequentially laminated. In this case, the overlapping gate metal layer is removed for doping of the first hold condenser plate 133, thus forming the second hold condenser plate 128*q* by using only the transparent electrode layer. Further, the pixel electrode 191 connected to the driving thin film transistor Td is formed of only the transparent electrode layer because the overlapping upper gate metal layer is removed.

The interlayer insulating layer 160 covering the driving gate electrode 125*a* and the horizontal compensation control line 122*b* is formed on the gate insulating layer 140. The gate insulating layer 140 and the interlayer insulating layer 160 have a contact hole 63 through which a drain region of the driving semiconductor layer 131*a* is exposed together. The interlayer insulating layer 160, like the gate insulating layer 140, is made of a ceramic-based material such as silicon nitride (SiNx) or silicon oxide ($SiO_2$).

Data wires including the data line 171 including the switching source electrode 176*b* and the initialization source electrode 176*d*, the vertical driving voltage line 172*a*, the driving source electrode 176*a*, the driving drain electrode 177*a*, the compensation source electrode 176*c*, the vertical compensation control line 122*a*, the vertical operation control line 123*a*, and the connection member 51 are formed on the interlayer insulating layer 160.

Further, the switching source electrode 176*b* and the initialization source electrode 176*d* are connected through a contact hole 61 formed in the interlayer insulating layer 160 and the gate insulating layer 140 to a source region of the switching semiconductor layer 131*b* and a source region of the initialization semiconductor layer 131*d*, respectively.

The vertical driving voltage line 172*a* is connected through the contact hole 68 formed in the interlayer insulating layer 160 to the horizontal driving voltage line 172*b*, the vertical compensation control line 122*a* is connected through the contact hole 62 formed in the interlayer insulating layer 160 to the horizontal compensation control line 122*b*, and the vertical operation control line 123*a* is connected through the contact hole 69 formed in the interlayer insulating layer 160 to the horizontal operation control line 123*b*.

The driving source electrode 176*a* and the driving drain electrode 177*a* are connected through the contact holes 67 and 63 formed in the interlayer insulating layer 160 and the gate insulating layer to a source region and a drain region of the driving semiconductor layer 131*a*, respectively, the driving drain electrode 177*a* is connected through the contact hole 64 formed in the interlayer insulating layer 160 to the pixel electrode 191, and the connection member 51 is connected through the contact holes 65 and 72 formed in the interlayer insulating layer 160 to the driving gate electrode 125*a* and the first compensation condenser plate 134.

As described above, the vertical compensation control line 122*a* is connected through the contact hole 62 formed in the interlayer insulating layer 160 to the horizontal compensation control line 122*b* at a crossing position with the horizontal compensation control line 122*b*.

A plurality of compensation control lines 122 simultaneously transferring the compensation control signal Gc and the initialization signal Vinit is formed in a simultaneous emission with active voltage type organic light emitting diode display. However, in the case where a plurality of compensation control lines 122 is formed only in parallel to the data line 171, a difference in luminances occurs due to a signal delay between the compensation control line 122 that is close to an input terminal and the compensation control line 122 that is far from the input terminal among a plurality of compensation control lines 122, thus forming mura. That is, in the case where the data signal is applied through the data line 171, an end of the hold capacitor Chold is shaken, accordingly, a deviation to the original data signal may occur by a signal delay (RC delay) as going away from the input terminal of the compensation control line 122, thus forming the mura in a direction of the compensation control line 122. The compensation control line 122 may be formed in a mesh form in order to remove the mura, but in the case where the compensation control line 122 having the mesh form is formed, an opening ratio is reduced.

As described above, in the case where only a plurality of vertical compensation control lines 122*a* is formed, since the compensation control signals are divided at the input terminal of the vertical compensation control line 122*a* and transferred, a deviation in compensation control signals occurs between the input terminal of the vertical compensation control line 122*a* and the vertical compensation control line 122*a* formed at a position that is far therefrom due to the signal delay (RC delay) when the data signal is programmed, such that luminance of the pixel is made non-uniform.

However, in the organic light emitting diode display according to the exemplary embodiment, as shown in FIGS. 2 and 3, since both the vertical compensation control line 122*a* and the horizontal compensation control line 122*b* are formed, the deviation in the compensation control signal between the vertical compensation control lines 122*a* is alleviated by the horizontal compensation control line 122*b*, accordingly, luminances of all the pixels are made uniform.

That is, since the compensation control signal transferred through the vertical compensation control line 122*a* is transferred through even the horizontal compensation control line 122*b*, a signal delay phenomenon occurring in the pixel that is far from the input terminal of the vertical compensation control line 122*a* may be prevented. Accordingly, it is possible to prevent occurrence of the mura due to a reduction in luminance by the signal delay phenomenon.

Further, since the second hold condenser plate 128*q* of the hold capacitor Chold is used as the horizontal compensation control line 122*b*, a separate horizontal compensation control line 122 may not need to be formed, thus prevent deterioration of the opening ratio occurring in the case where the separate horizontal compensation control line 122 is formed.

The protective layer 180 covering the data wires 171, 172*a*, 176*a*, 177*a*, 176*c*, 122*a*, 123*a*, and 51 is formed on the interlayer insulating layer 160, and the pixel electrode 191 is exposed through an opening 181 formed in the protective layer 180. The pixel electrode 191 is connected through the contact hole 64 formed in the protective layer 180 to the driving drain electrode 177*a*.

An organic emission layer 370 is formed on the pixel electrode 191 exposed through the opening 181, and the common electrode 270 is formed on the organic emission layer 370. As described above, the organic light emitting diode 70 including the pixel electrode 191, the organic emission layer 370, and the common electrode 270 is formed.

Herein, the pixel electrode 191 is an anode that is a hole injection electrode, and the common electrode 270 is a cathode that is an electron injection electrode. However, the exemplary embodiment according to the present invention is not limited thereto, and the pixel electrode 191 may be the cathode and the common electrode 270 may be the anode according to the driving method of the organic light emitting diode display. Holes and electrons are injected from the pixel electrode 191 and the common electrode 270 into the organic emission layer 370, and when an exciton that is combined with the injected holes and electrons falls from an exited state to a bottom state, light is emitted.

The organic emission layer 370 may be formed of a low molecular weight organic material or a high molecular weight organic material. Further, the organic emission layer 370 may be formed of a multilayer including one or more of an emission layer, a hole injection layer HIL, a hole transport layer HTL, an electron transport layer ETL, and an electron injection layer EIL. In the case where all the layers are included, the hole injection layer HIL is disposed on the pixel electrode 191 that is the anode, and the hole transport layer HTL, the emission layer, the electron transport layer ETL, and the electron injection layer EIL are sequentially laminated thereon. Since the common electrode 270 is formed of a reflective conductive material, a rear surface light emission type organic light emitting diode display may be obtained. Material such as lithium (Li), calcium (Ca), lithium fluoride/calcium (LiF/Ca), lithium fluoride/aluminum (LiF/Al), aluminum (Al), silver (Ag), magnesium (Mg), or gold (Au) may be used as the reflective material.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An organic light emitting diode display, comprising:

a substrate;

a scan line formed on the substrate and transferring a scan signal;

a compensation control line crossing the scan line and transferring a compensation control signal;

an operation control line crossing the scan line and applying an operation control signal;

a data line and a driving voltage line crossing the scan line and transferring a data signal and a driving voltage, respectively;

a switching thin film transistor connected to the scan line and to the data line;

a compensation thin film transistor and an initialization thin film transistor connected to the compensation control line;

an operation control thin film transistor connected to the operation control line and the switching thin film transistor;

a driving thin film transistor connected to the driving voltage line;

an organic light emitting diode connected to a driving drain electrode of the driving thin film transistor; and a hold capacitor connected between an operation control source electrode of the operation control thin film transistor and an initialization gate electrode of the initialization thin film transistor, wherein the compensation control line includes a vertical compensation control line formed in parallel to the data line and a horizontal compensation control line connected to the vertical compensation control line to cross the vertical compensation control line.

2. The organic light emitting diode display of claim 1, further comprising:

a storage capacitor connected between the driving voltage line and the operation control thin film transistor; and a compensation capacitor connected between the operation control thin film transistor and the driving gate electrode of the driving thin film transistor.

3. The organic light emitting diode display of claim 1, wherein the hold capacitor includes:

a first hold condenser plate connected to a drain electrode of the switching thin film transistor; and a second hold condenser plate overlapping the first hold condenser plate and connected to the horizontal compensation control line.

4. The organic light emitting diode display of claim 3, wherein the first hold condenser plate is formed on the same layer as a switching semiconductor layer of the switching thin film transistor, and the second hold condenser plate is formed on the same layer as the scan line.

5. The organic light emitting diode display of claim 4, wherein the second hold condenser plate protrudes upward and downward from the horizontal compensation control line.

6. The organic light emitting diode display of claim 5, wherein the horizontal compensation control line includes a gate metal layer and a transparent electrode layer sequentially laminated, and the second hold condenser plate is formed of only a transparent electrode layer.

7. The organic light emitting diode display of claim 6, wherein the vertical compensation control line is formed on the same layer as the data line.

8. The organic light emitting diode display of claim 7, further comprising:

a gate insulating layer formed on the first hold condenser plate; and an interlayer insulating layer covering the second hold condenser plate formed on the gate insulating layer, wherein the horizontal compensation control line is connected through a contact hole formed in the interlayer insulating layer to the vertical compensation control line.

9. The organic light emitting diode display of claim 8, wherein the driving voltage line includes a vertical driving voltage line formed in parallel to the data line and a horizontal driving voltage line connected to the vertical driving voltage line to cross the vertical driving voltage line.

10. The organic light emitting diode display of claim 8, wherein the operation control line includes a vertical operation control line formed in parallel to the data line and a horizontal operation control line connected to the vertical operation control line to cross the vertical operation control line.

11. The organic light emitting diode display of claim 10, wherein the vertical operation control line is formed on the same layer as the data line, and the horizontal operation control line is formed on the same layer as the scan line.

* * * * *